US006792903B2

(12) United States Patent
Morrn

(10) Patent No.: US 6,792,903 B2
(45) Date of Patent: Sep. 21, 2004

(54) MECHANICAL CONTROL OF THE INTAKE VALVE LIFT ADJUSTMENT IN AN INTERNAL COMBUSTION ENGINE

(75) Inventor: Bernhard Morrn, Siegburg (DE)

(73) Assignee: STS System Technology Services GmbH, Cologne (DE)

( * ) Notice: Subject to any disclaimer, the term of this patent is extended or adjusted under 35 U.S.C. 154(b) by 0 days.

(21) Appl. No.: 10/137,971

(22) Filed: May 3, 2002

(65) Prior Publication Data

US 2002/0162522 A1 Nov. 7, 2002

(30) Foreign Application Priority Data

May 3, 2001 (EP) ..... 01110782

(51) Int. Cl.[7] ..... F01L 1/34

(52) U.S. Cl. ..... 123/90.16; 123/90.15; 74/53

(58) Field of Search ..... 123/90.15, 90.16, 123/90.17; 74/53–55, 567, 568 R, 569, 25

(56) References Cited

U.S. PATENT DOCUMENTS

| | | | | |
|---|---|---|---|---|
| 4,543,927 A | * | 10/1985 | Luhn et al. | 123/182.1 |
| 4,572,118 A | | 2/1986 | Baguena | 123/90.16 |
| 5,027,760 A | | 7/1991 | Storchi | 123/90.16 |
| 5,406,835 A | * | 4/1995 | Doll | 73/118.1 |
| 5,692,465 A | * | 12/1997 | Sawada et al. | 123/90.16 |
| 6,386,162 B2 | * | 5/2002 | Himsel | 123/90.16 |

FOREIGN PATENT DOCUMENTS

| | | |
|---|---|---|
| DE | 4326331 A1 | 2/1995 |
| DE | 19708484 A1 | 9/1998 |
| EP | 0780547 A1 | 6/1997 |
| EP | 1039103 A3 | 9/2000 |
| EP | 1096115 A1 | 5/2001 |

* cited by examiner

*Primary Examiner*—Thomas Denion
*Assistant Examiner*—Jaime Corrigan
(74) *Attorney, Agent, or Firm*—Perman & Green, LLP

(57) ABSTRACT

The present invention relates to a mechanically controllable valve lift adjustment. The present invention also relates to an internal combustion engine having a mechanically controllable valve lift adjustment and to a method of controlling the valve lift in internal combustion engines.

21 Claims, 5 Drawing Sheets

MECHANICAL CONTROL OF THE INTAKE VALVE LIFT ADJUSTMENT IN AN INTERNAL COMBUSTION ENGINE

The present invention relates to a mechanically controllable valve lift adjustment. The present invention also relates to an internal combustion engine having a mechanically controllable valve lift adjustment and to a method of controlling the valve lift in internal combustion engines.

In internal combustion engines, when changing from full load to partial load, a negative pressure occurs in the suction unit, causing more fuel than required to be drawn into the cylinders. As a result, the fuel consumption of the internal combustion engine is increased, and unburned fuel is possibly released into the environment.

The object therefore is to provide a device by means of which the fuel consumption in an internal combustion engine can be reduced.

Said object is accomplished by providing a mechanically controllable valve lift adjustment for an internal combustion engine having multiple cylinders, including:

at least one lifting lever per cylinder, which has
- a means bearing the lifting lever rotatably and displaceably in a connecting member,
- a drive transmission means cooperating with a camshaft driving the lifting lever, and
- a working curve, a means which cooperates with the displaceable, rotatable bearing of the lifting levers, displacing the latter in the connecting members, a camshaft which cooperates with the drive transmission means of the lifting lever and drives the latter, at least one valve per cylinder, which cooperates with the working curve of one lifting lever at a time, being moved by same, the means displacing the lifting lever being a driven rail held displaceably in a bearing in the housing of the internal combustion engine.

In another embodiment, the valve lift adjusting means according to the invention additionally has a roll drag lever which, on the one hand, cooperates with the working curve of the lifting lever, being driven by same, and, on the other hand, cooperates with the valve and moves the latter.

According to the invention, the valve lift adjusting means has a means bearing the lifting lever rotatably and displaceably in a connecting member. Said means preferably is a roll.

The connecting member receives said means, thus representing a guide thereof, wherein said means—and the lifting lever at the same time—is displaced under pressure and/or traction. The connecting member can be of any shape, the shape being selected by a person skilled in the art in such a way that the lifting lever preferably can be displaced along a particular straight line and/or curve.

However, the connecting member preferably is of an essentially rectangular shape, the short sides of the rectangle preferably being designed so as to take the shape of a semicircle. Such a shape of the connecting member is particularly suited to receive rolls. The connecting member can be arranged horizontally or vertically, or at any angle with respect to the horizontal and/or vertical.

According to the invention, the internal combustion engine has at least two cylinders, each cylinder being associated with at least one lifting lever. By means of a driven rail held displaceably in a bearing in the housing of the internal combustion engine, the position of the lifting levers is changed so as to adjust the cylinder lift. Preferably, the rail is moved back and forth along a straight line.

In a preferred embodiment of the present invention, one cylinder has two intake valves and accordingly, two lifting levers. According to the invention, these two lifting levers can be displaced either by one driven rail or by two driven rails, and in this latter case, one lifting lever is displaced by one rail at a time. This latter embodiment is advantageous in that the lifting levers and thus, the valves, can be adjusted independently, allowing an even more variable control of the internal combustion engine. In extreme cases, a so-called zero lift is implemented on one valve, while the other valve is completely opened.

The rail can be driven in any way known to those skilled in the art. For example, the drive is by hydraulic or pneumatic means using an electric lifting magnet, an electric motor preferably having a transmission, or a piezo motor.

Preferably, the means cooperating with the camshaft is a roll.

The valve control of the invention is suitable for valves of any type. However, the valves preferably are valves of internal combustion engines, more preferably intake valves of internal combustion engines.

Therefore, the present invention is also directed to an internal combustion engine having at least one valve control according to the invention.

Furthermore, the present invention is directed to a method of controlling the intake valve lift of an internal combustion engine using the valve control according to the invention, wherein at least two lifting levers are displaced in the connecting member by a driven rail in accordance with the requirements as to the performance of the internal combustion engine.

Under partial load, the lifting lever is displaced in such a way—and maintained in this position for some time—that the valve or the roll drag lever makes contact with that part of the working curve of the lifting lever which provides a reduced valve lift.

Under full load, the lifting lever is displaced in such a way—and maintained in this position for some time—that the valve or the roll drag lever makes contact with that part of the working curve of the lifting lever which provides maximum valve lift.

The present invention is advantageous in that the valve lift can be increased or reduced depending on the performance required. The valve lift adjustment according to the invention reduces the load alternation work in Otto engines, resulting in fuel savings of up to 10% compared to prior art valve control. The production of a mechanical control is substantially easier and thus, more cost-effective compared to e.g. an electronic valve lift control. The valve control according to the invention is very robust and insensitive in terms of maintenance. By using a rail displacing the position of the lifting levers, the number of component parts required is substantially less compared to the prior art.

With reference to the FIGS. 1 to 5, the invention will be illustrated below. These illustrations are merely by way of example and do not limit the general idea of the invention.

FIG. 1*a* shows the valve control of the invention for a two-valve cylinder.

FIG. 1*b* shows an embodiment of the lifting lever bearing in a four-valve cylinder.

Figures 1A, 1B:
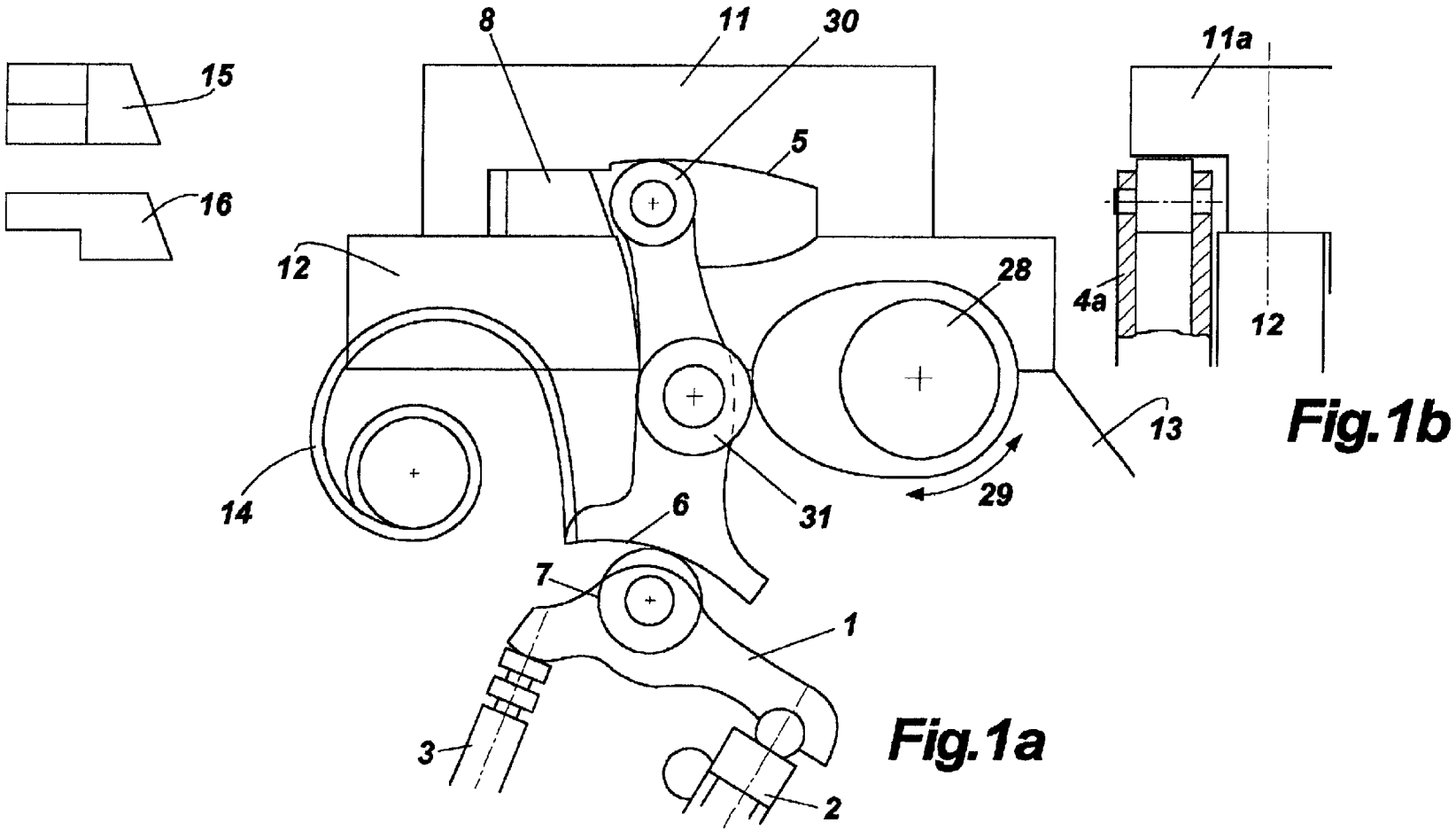

FIG. 1*a* illustrates the inventive valve control for a two-valve engine (one intake valve and one exhaust valve).

A lifting lever 4 is held displaceably and rotatably in a bearing in connecting member 5 by roll 30. The lifting lever is displaced within the connecting member by rail 8 and return spring 14. The connecting member 5 and the bearing or guide of rail 8 is integrated in a cover 11 of the engine, which cover is mounted on the cylinder head 13 or on an intermediate support 12 in a precisely aligned fashion. Those skilled in the art will appreciate that by means of rail 8 and return spring 14, the lifting lever 4 can also be held in a particular position within the connecting member. The rail 8 extends vertically to the paper plane along all of the cylinders present in the engine or the intake valves thereof which are arranged in line. The position of rail 8 is detected by a path sensor (not shown), or e.g. via the revolutions of an electric motor driving the rail, and transmitted as actual value to an electronic control device. The control device controls the desired position of the intake valve via set value/actual value comparison.

In addition, the lifting lever 4 has another roll 31 which cooperates with the camshaft 28 and drives the lifting lever 4.

In its lower portion, the lifting lever 4 has a working curve 6. This working curve is in contact with roll 7 which is affixed to the roll drag lever 1. The roll drag lever 1 in turn moves the valve 3 (represented in part).

The left portion of the working curve preferably is a circle about the center of the roll 30. This ensures a zero lift in the position as represented.

The transition from the left (zero lift range) to the right (lift range) of the working curve defines the acceleration ramp of the intake valve motion. The acceleration ramp of the camshaft 28 only serves to accelerate the lifting lever 4 and has no effect on the valve acceleration.

For example, when operating an internal combustion engine under partial load, the lifting lever 4 will be displaced in the connecting member 5 in such a way that the roll drag lever 1 cooperates with the left portion of the working curve 6, so that the lift of valve 3 will be reduced. Under full load, however, the lifting lever 4 will be displaced in the connecting member 5 in such a way that the right portion of the working curve 6 is in contact with the roll drag lever 1 so as to have maximum lift of valve 3.

FIG. 1*b* shows a detail of a four-valve engine (two intake valves and two exhaust valves). In this case, the engine has two intake valves per cylinder, the lift behavior of which being controlled independently by the two lifting levers 4*a*, 4*b* (only lifting lever 4*a* is shown). In this example, the rail 8 can be divided into two as represented by the rails 15, 16. The rails 15, 16 are driven independently. Using such an arrangement, independent valve lift control of both intake valves is possible. For example, it is possible to set one intake valve to zero lift and use the valve lift of the other valve alone for torque control. Similarly, the position of the respective rail 15, 16 is detected and used for control in this embodiment. Likewise, the rails 15, 16 extend over all of the cylinders, arranged in line, or over the valves thereof, the lift of which is changed by the respective rail.

Figure 2:
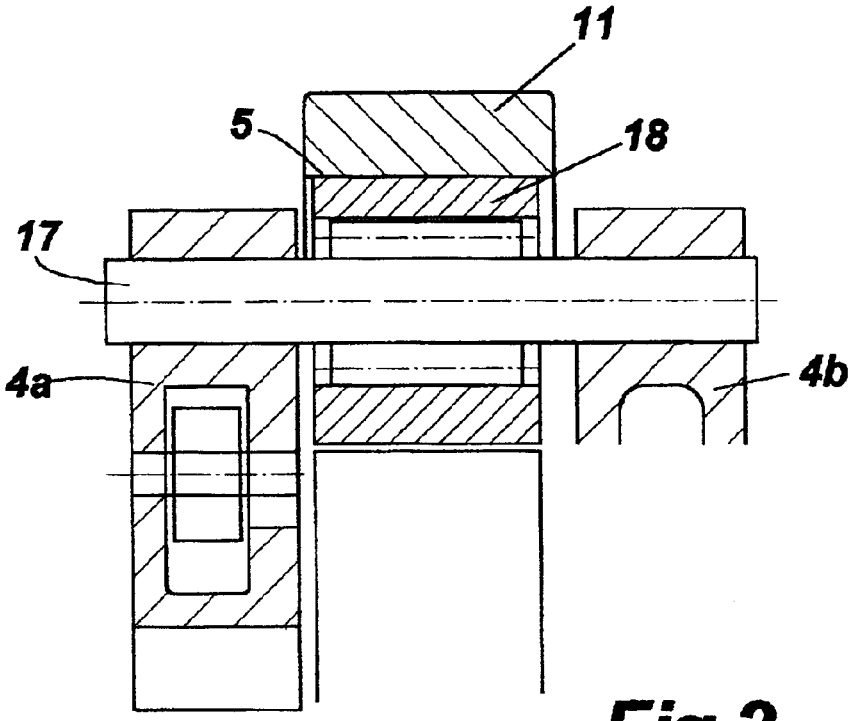
FIG. 2 shows another embodiment of a lifting lever bearing in a four-valve cylinder.

FIG. 2 shows another embodiment of the bearing of the lifting levers 4*a*, 4*b* in a four-valve cylinder. In this event, the two lifting levers 4*a*, 4*b* are held non-rotatably on a common axis 17. The axis 17 in turn is held rotatably in a roller bearing 18. The roller bearing 18 can be displaced from the rail 8 along the connecting member 5. The rail 8 is not bipartite.

The axis 17 may also extend over all of the cylinders, so that all of the lifting levers are aligned on an axis and held in valve position e.g. by spacer bushings.

Figure 3:
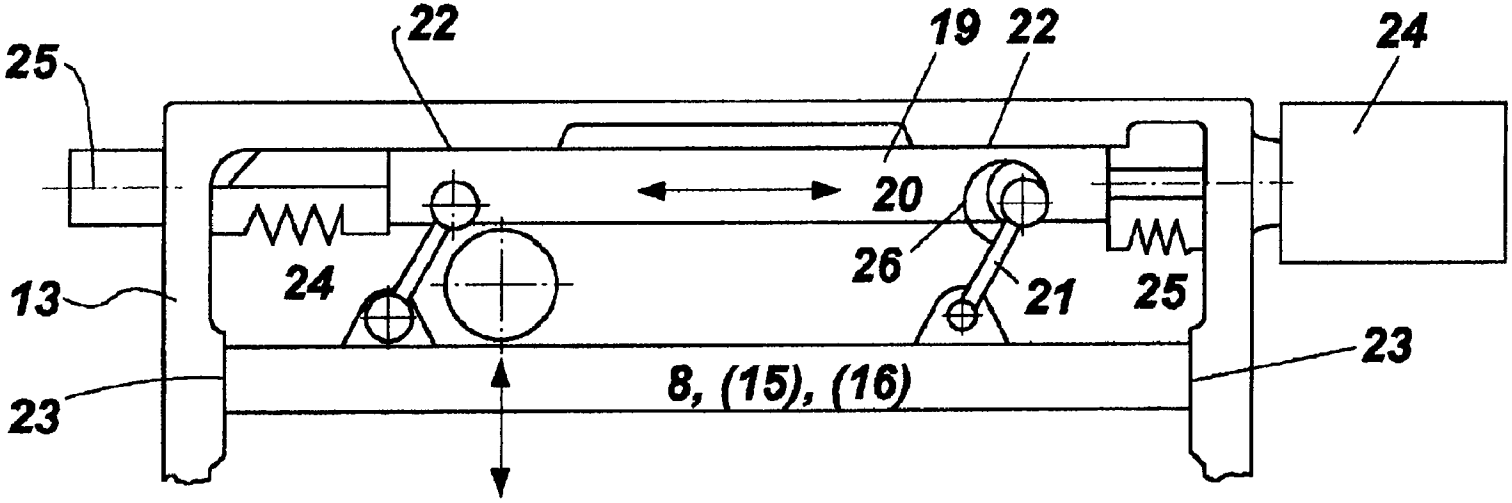
FIG. 3 shows a parallelogram for the drive of the rail.

FIG. 3 shows a possible form of driving the rails 8 or the rails 15, 16 which, in the present example, are part of a parallelogram formed by the rails 8 and 19 and the two levers 21. Hereinafter, reference will be made to the rails 8 and 19 only. The rails 8 and 19 and the levers 21 are connected rotatably in the paper plane, at least two levers 21 being used in a four-cylinder engine and three or more levers 21 in a six-cylinder engine. By means of bearings, the rail 19 is held displaceably along the horizontal in both directions, as indicated by the double arrow 20. The bearings 22, situated in the cylinder head, can be slide or roller bearings. The rail 8 extends through the bearings 23 in the cylinder head along a vertical line, and its position can be determined using path sensors. The rail 19 is adjusted via a motor 24 and a screw thread. In this case, the position of rail 8 and thus, the adjusted lift of the intake valve, can be measured by means of a path sensor 25 detecting the position of rail 19. Likewise, the position of rail 8 can be measured by detecting the engine revolutions. Those skilled in the art will recognize that many other means, e.g. a hydraulic unit, a lifting magnet, a stepper motor, a mechanically actuated lever, or a cable control, are suitable in accomplishing the adjustment of rail 19. The horizontal movement 20 of rail 19 is supported by the springs 24 and 25.

Figure 4:
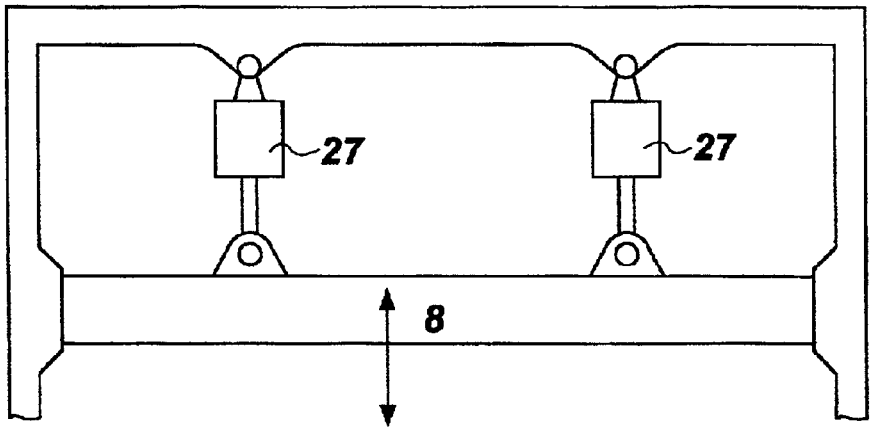
FIG. 4 shows two actuators to drive the rail.

FIG. 4 shows the drive of rail 8 by means of at least two actuators 27. For example, these actuators can be lifting magnets, electric motors with or without a transmission, piezo motors, or mechanical, hydraulic or pneumatic means.

Figure 5:
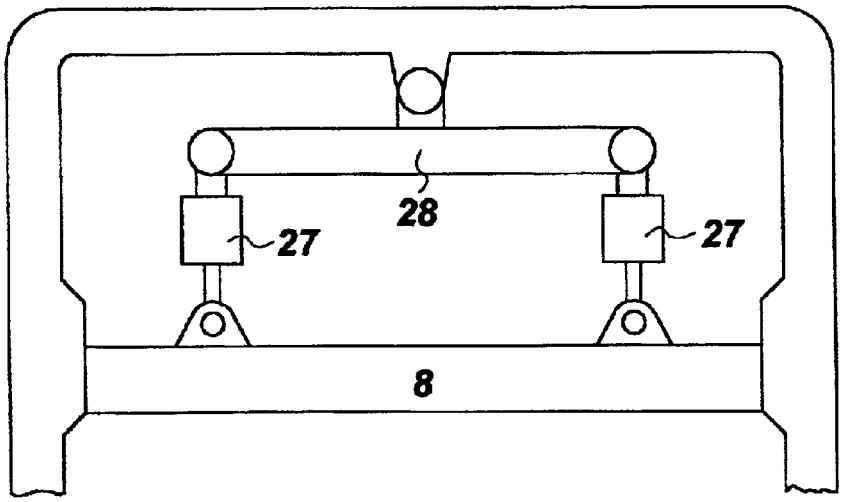
FIG. 5 shows two actuators to drive the rail with a force regulator 32.

In addition to FIG. 4, FIG. 5 shows a force regulator 32 cooperating with the actuators 27. This arrangement increases the accuracy of the idling valve lift.

What is claimed is:

1. A valve lift adjustment device for an internal combustion engine having multiple cylinder, the device comprising:

a connecting member;

at least one lifting lever movably connected to the connecting member, the lifting lever having:

a bearing rotatably and linearly displaceably bearing the lifting lever against the connecting member so that the lifting lever is rotatably and linearly displaceable relative to the connecting member, a cam follower for driving the lifting lever, and a working curve connected to a valve of one of the cylinders;

a drive rail cooperating with the bearing for displacing the lifting lever in the connecting member; and a camshaft cooperating with the cam follower to drive the lifting lever, the working curve of the lifting lever moving the valve.

2. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a means (8) which cooperates with the means (30) of the lifting lever (4), displacing the latter in the connecting member (5), a camshaft (28) which cooperates with the means (31) of the lifting lever (4) and drives the latter, at least one valve per cylinder, which cooperates with the working curve (6) of one lifting lever (4) at a time, being moved by same, characterized in that the means (8) is a driven rail held displaceably in a bearing in the housing (11, 12) of the internal combustion engine.

3. The valve control according to claim 1, characterized in that the position of the rail (8, 15, 16, 19) is detected, said position being used as actual value to control the valve lift.

4. The valve control according to claim 1, characterized in that the rail (8, 15, 16) is driven by a parallelogram.

5. The valve control according to claim 1, characterized in that the valve is an intake valve of an internal combustion engine.

6. An internal combustion engine, characterized in that the engine has at least one valve control according to claim 1.

7. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a means (8) which cooperates with the means (30) of the lifting lever (4), displacing the latter in the connecting member (5), a camshaft (28) which cooperates with the means (31) of the lifting lever (4) and drives the latter, a roll drag lever (1) which cooperates with the working curve (6) of the lifting lever (4), being moved by same, at least one valve per cylinder, which cooperates with the working curve (6) of one lifting lever (4) at a time, being moved by same, characterized in that the means (8) is a driven rail held displaceably in a bearing in the housing (11, 12) of the internal combustion engine.

8. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a means (8) which cooperates with the means (30) of the lifting lever (4), displacing the latter in the connecting member (5), a camshaft (28) which cooperates with the means (31) of the lifting lever (4) and drives the latter, at least one valve per cylinder, which cooperates with the working curve (6) of one lifting lever (4) at a time, being moved by same, characterized in that the means (8) is a driven rail held displaceably in a bearing in the housing (11, 12) of the internal combustion engine; and characterized in that each one cylinder is associated with two lifting levers (4) displaced jointly by one rail (8) or independently by two rails (15, 16).

9. A method of controlling the intake valve lift of an internal combustion engine using a mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a means (8) which cooperates with the means (30) of the lifting lever (4), displacing the latter in the connecting member (5), a camshaft (28) which cooperates with the means (31) of the lifting lever (4) and drives the latter, at least one valve per cylinder, which cooperates with the working curve (6) of one lifting lever (4) at a time, being moved by same, characterized in that the means (8) is a driven rail held displaceably in a bearing in the housing (11, 12) of the internal combustion engine; and, characterized in that at least two lifting levers (4) are displaced in the connecting member (5) by a driven rail (8, 15, 16) in accordance with the requirements as to the performance of the internal combustion engine.

10. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever 4, displacing the latter in the connecting member (5), a camshaft (28) which cooperates with the means (31) of the lifting lever (4) and drives the latter, at least one valve per cylinder, which cooperates with the working curve (6) of one lifting lever (4) at a time, being moved by same.

11. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever 4, displacing the latter in the connecting member (5), a camshaft (28) which cooperates with the means (31) of the lifting lever (4) and drives the latter, a roll drag lever (1) which cooperates with the working curve (6) of the lifting lever (4), being moved by same, at least one valve per cylinder, which cooperates with the working curve (6) of one lifting lever (4) at a time, being moved by same.

12. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever 4, displacing the latter in the connecting member (5), a camshaft (28) which cooperates with the means (31) of the lifting lever (4) and drives the latter, at least one valve per cylinder, which cooperates with the working curve (6) of one lifting lever (4) at a time, being moved by same, characterized in that each cylinder is associated with two lifting levers (4) displaced jointly by one rail (8) or independently by two rails (15, 16).

13. A method of controlling the intake valve lift of an internal combustion engine using a mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a means (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever (4), displacing the latter in the connecting member (5), a camshaft (28) which cooperates with the means (31) of the lifting lever (4) and drives the latter, at least one valve per cylinder, which cooperates with the working curve (6) of one lifting lever (4) at a time, being moved by same, characterized in that at least two lifting levers (4) are displaced in the connecting member (5) by said driven rail (8, 15, 16) in accordance with the requirements as to the performance of the internal combustion engine.

14. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine said driving rail (8) cooperating with the means (30) of the lifting lever (4), displacing the latter in the connecting member, a camshaft (28) which cooperates with the roll (31) of the lifting lever (4) and drives the latter, at least one valve per cylinder, which cooperates with the working curve (6) of one lifting lever (4) at a time, being moved by same.

15. A mechanically controllable valve lift adjustment for an internal combustion engine having multiple cylinders, including:

at least one lifting lever (4) per cylinder, which has a means (3) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever (4), displacing the latter in the connecting member (5), a camshaft (28) which cooperates with the roll (31) of the lifting lever (4) and drives the latter, a roll drag lever (1) which cooperates with the working curve (6) of the lifting lever (4), being moved by same, at least one valve per cylinder, which cooperates with the working curve (6) of one lifting lever (4) at a time, being moved by same.

16. A mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever (4), displacing the latter in the connecting member (5), a camshaft (28) which cooperates with the roll (31) of the lifting lever (4) and drives the latter, at least one valve per cylinder, which cooperates with the working curve (6) of one lifting lever (4) at a time, being moved by same, characterized in that each one cylinder is associated with two lifting levers (4) displaced jointly by one rail (8) or independently by two rails (15, 16).

17. A method of controlling the intake valve lift of an internal combustion engine using a mechanically controllable valve lift adjustment for an internal combustion engine having multiple cylinders, including:

at least one lifting lever (4) per cylinder, which has a means (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever (4), displacing the latter in the connecting member (5), a camshaft (28) which cooperates with the roll (31) of the lifting lever (4) and drives the latter, at least one valve per cylinder, which cooperates with the working curve (6) of one lifting lever (4) at a time, being moved by same, characterized in that at least two lifting levers (4) are displaced in the connecting member (5) by said driven rail (8, 15, 16) in accordance with the requirements as to the performance of the internal combustion engine.

18. A mechanically controllable valve lift adjustment for an internal combustion engine having multiple cylinders, including:

at least one lifting lever (4) per cylinder, which has a bearing (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the bearing (30) of the lifting lever (4), displacing the latter in the connecting member (5), a camshaft (28) which cooperates with the roll (31) of the lifting lever (4) and drives the latter, at least one valve per cylinder, which cooperates with the working curve (6) of one lifting lever (4) at a time, being moved by same.

19. A mechanically controllable valve lift adjustment for an internal combustion engine having multiple cylinders, including:

at least one lifting lever (4) per cylinder, which has a bearing (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the bearing (30) of the lifting lever (4), displacing the latter in the connecting member (5), a camshaft (28) which cooperates with the roll (31) of the lifting lever (4) and drives the latter, a roll drag lever (1) which cooperates with the working curve (6) of the lifting lever (4), being moved by same, at least one valve per cylinder, which cooperates with the working curve (6) of one lifting lever (4) at a time, being moved by same.

20. A mechanically controllable valve lift adjustment for an internal combustion engine having multiple cylinders, including:

at least one lifting lever (4) per cylinder, which has a bearing (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever (4), displacing the latter in the connecting member (5), a camshaft (28) which cooperates with the roll (31) of the lifting lever (4) and drives the latter, at least one valve per cylinder, which cooperates with the working curve (6) of one lifting lever (4) at a time, being moved by same, characterized in that each one cylinder is associated with two lifting levers (4) displaced jointly by one rail (8) or independently by two rails (15, 16).

21. A method of controlling the intake valve lift of an internal combustion engine using a mechanically controllable valve lift adjustment for an internal combustion engine having multiple cylinders, including:

at least one lifting lever (4) per cylinder, which has a bearing (30) bearing the lifting lever (4) rotatably and displaceably in a connecting member (5), a roll (31) cooperating with a camshaft (28) driving the lifting lever (4), and a working curve (6), a driven rail (8) held displaceably in a bearing in the housing (11, 12) of the internal combustion engine, said driven rail (8) cooperating with the means (30) of the lifting lever (4), displacing the latter in the connecting member (5), a camshaft (28) which cooperates with the roll (31) of the lifting lever (4) and drives the latter, at least one valve per cylinder, which cooperates with the working curve (6) of one lifting lever (4) at a time, being moved by same, characterized in that at least two lifting levers (4) are displaced in the connecting member (5) by said driven rail (8, 15, 16) in accordance with the requirements as to the performance of the internal combustion engine.

* * * * *

UNITED STATES PATENT AND TRADEMARK OFFICE

CERTIFICATE OF CORRECTION

PATENT NO. : 6,792,903 B2
DATED : September 21, 2004
INVENTOR(S) : Morm

It is certified that error appears in the above-identified patent and that said Letters Patent is hereby corrected as shown below:

Title page,
Item [75], Assignee, delete “Cologne” and insert -- Koln --.

Column 5,
Lines 4, 7, 9 and 13, delete “claim 1” and insert -- claim 2 --.

Column 6,
Lines 32 and 52, delete “4” and insert -- (4) --.

Column 7,
Line 66, delete “(3)” and insert -- (30) --.

Signed and Sealed this

Twenty-fourth Day of May, 2005

JON W. DUDAS
*Director of the United States Patent and Trademark Office*